US005233321A

United States Patent [19]

Blanchard et al.

[11] Patent Number: 5,233,321

[45] Date of Patent: Aug. 3, 1993

[54] PROTECTIVE SWITCH

[75] Inventors: Christian Blanchard, Rueil Malmaison; Michel Lauraire, Courbevoie; Didier Vigouroux, Jouy Le Moutier, all of France

[73] Assignee: Telemecanique, France

[21] Appl. No.: 797,480

[22] Filed: Nov. 14, 1991

[30] Foreign Application Priority Data

Nov. 15, 1990 [FR] France ..... 90 14202

[51] Int. Cl.[5] ..... H01H 67/02

[52] U.S. Cl. ..... 335/132; 335/131; 335/202

[58] Field of Search ..... 335/131-132, 335/202, 6, 14, 20

[56] References Cited

U.S. PATENT DOCUMENTS 4,855,698 8/1989 Cohen et al. ..... 335/14
4,947,145 8/1990 Ohishi et al. ..... 335/14
4,973,929 11/1990 Duchemin ..... 335/132

*Primary Examiner*—Lincoln Donovan
*Attorney, Agent, or Firm*—William A. Drucker

[57] ABSTRACT

A protective switch device such as a contactor/circuit-breaker comprises double-contact switch poles. Contact bridges are housed in a mobile support. Slide members guided in slots of the support and commanded by a tripping mechanism can be applied to the bridges. The mobile support can be actuated by a solenoid without the contact pressure springs transmitting any reaction force to the armature of the solenoid.

8 Claims, 3 Drawing Sheets

PROTECTIVE SWITCH

BACKGROUND OF THE INVENTION

1. Field of the invention

The present invention concerns a protective switch device of the circuit-breaker or contactor/circuit-breaker type comprising at least one double-contact switch pole provided with a mobile contact bridge, a mobile support accommodating said contact bridge(s) and a contact pressure spring associated with each bridge.

In a device of this kind, commanded displacement of the support is adapted to cause displacement of the bridges; the bridges may be displaced relative to the support to enable the application of pressure to the contacts by springs. In the event of an electrical fault affecting at least one pole a magnetic and/or thermal tripping mechanism is adapted to operate via a control part to cause omnipolar opening of the contacts, for example by means of slide members movably mounted in the support; if the device is a contactor/circuit-breaker, an electrically or manually generated opening or closing command is adapted to be exerted via another control part to cause omnipolar opening of the contacts, for example by means of the aforementioned slide members or by means of a cage surrounding the support.

2. Description of the prior art

A device of this kind is disclosed in the patents FR - 2 634 590 and EP - 270 158. It has the disadvantage that, when opening is commanded by a solenoid, the latter has to overcome the force of the contact pressure springs because the active contact part is applied directly to the bridges. Also, the contact bridge operating systems prevent the overall dimensions of the device from being reduced as much as would be desirable. If the fixed contacts of the same pole are moved closer together there is insufficient electrical insulation, especially if the pole is opened electrodynamically.

An object of the invention is to achieve excellent electrical insulation between the two pairs of contacts of each pole of a circuit-breaker when the contacts are opened, especially when they are opened by electrodynamic repulsion of the contacts.

Another object of the invention is to reduce the overall dimensions of the support for the contact bridges of a protective switch device and to enable the designer of the device to move the fixed contacts of the same pole closer together to reduce the overall dimensions of the device and the mass of the mobile bridge.

A final object of the invention is to reduce the operating forces required in a contactor/circuit-breaker device of the type described.

SUMMARY OF THE INVENTION

According to the invention, in a circuit-breaker or contactor/circuit-breaker device of the above type, each contact bridge is fastened to the respective slide member in the direction of movement in translation.

When a pole is opened, especially when a pole is opened as the result of electrodynamic repulsion of facing fixed and mobile contacts, an insulative area on the slide member is inserted between the fixed contacts of the pole to maintain a satisfactory insulation distance between them.

In a preferred embodiment, each slide member is an independent part, in particular a lightweight and insulative part carrying the respective contact bridge, and this part has an insulative area which appears in a window of the first support when the contacts are opened by the control part and/or by electrodynamic repulsion of the contact bridge. Each contact bridge is preferably mounted in the respective slide member to allow angular movement between it and the latter; the contact pressure spring is housed in a window of the slide member outside the contact opening area.

One such embodiment is described hereinafter by way of non-limiting example and with reference to the appended drawings.

DETAILED DESCRIPTION OF THE INVENTION

Figure 1:
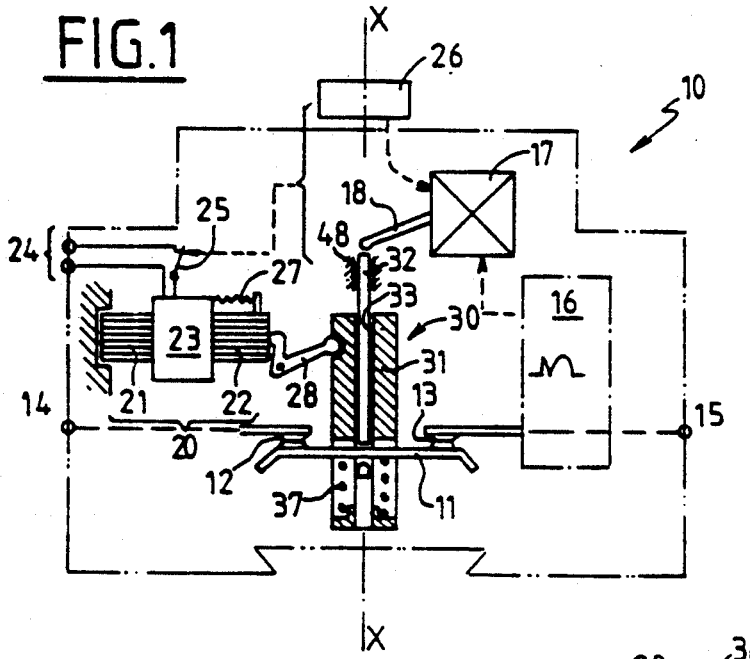
FIG. 1 is a diagram showing a contactor/circuit-breaker in accordance with the invention in elevation.
Figure 2:
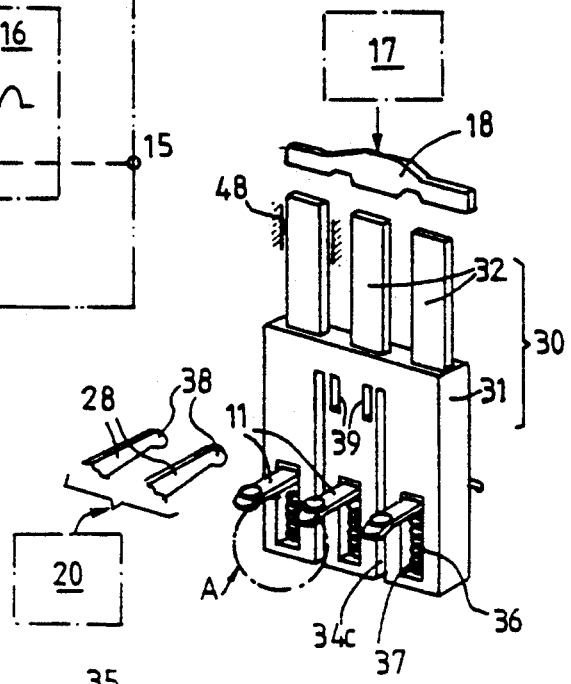
FIG. 2 is a perspective view of the contact-carrier structure of the device from FIG. 1.
Figure 3:
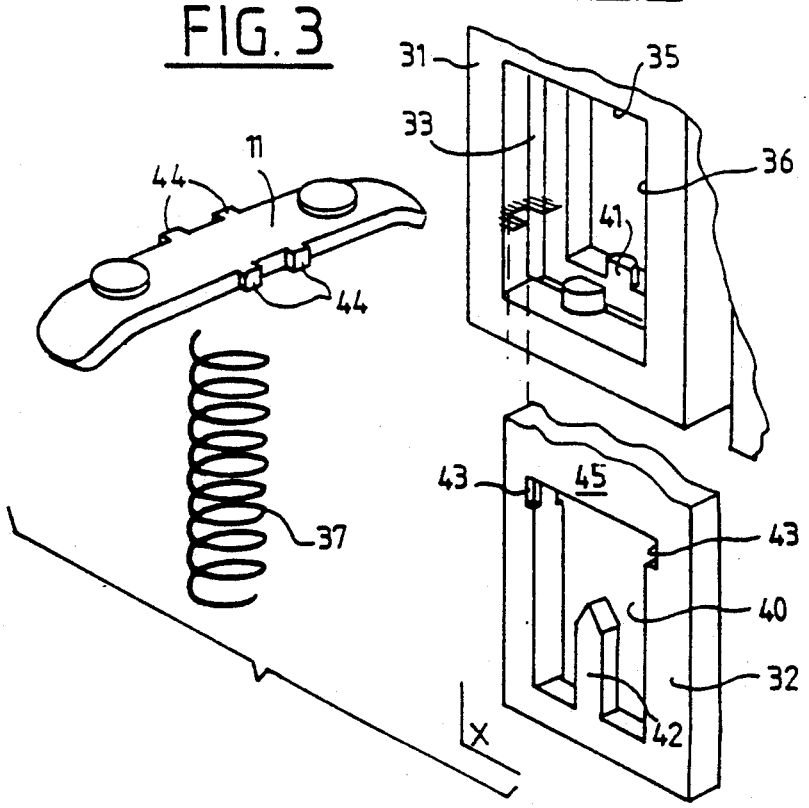
FIG. 3 is an exploded view to a larger scale of the detail A of the contact-carrier structure from FIG. 2.
Figure 4:
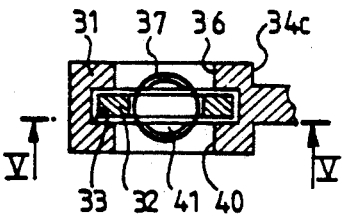
FIG. 4 is a plan view of part of this structure in cross-section on the plane IV—IV in FIG. 9.
Figure 5:
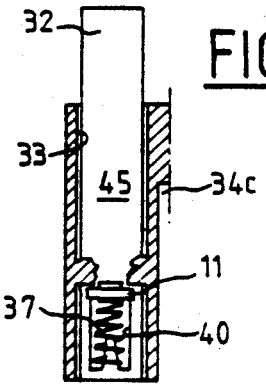
FIG. 5 is a view of the same part in cross-section on V—V.
Figure 6:
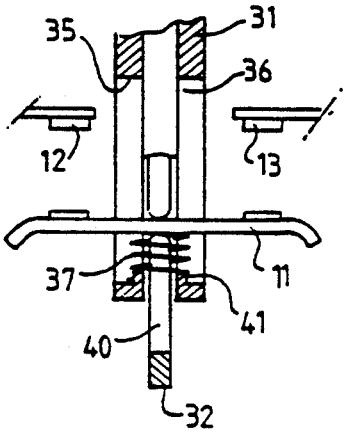
FIG. 6 is a view in cross-section of the lower part of the structure during opening of the contacts in response to a fault.

The circuit-breaker shown in FIG. 1 is a contactor/-circuit-breaker comprising, in a casing 10, a plurality of mechanical switch poles each of which comprises a mobile contact bridge 11. Each bridge cooperates through respective contact pads with two fixed contacts 12, 13 connected to terminals 14, 15 to allow or interrupt the passage of a power current between these terminals.

A magnetic and thermal tripping system 16 is disposed on each current path in the casing. If the system 16 senses an excess current on the current path it operates through the intermediary of a mechanism 17 provided with a plunger or a lever 18 on a structure 30 which supports and moves the contact bridges. As will be explained later, the lever 18 can be applied to a member of the structure 30. The system 16 comprises a magnetic tripping device and a thermal tripping device for each pole, for example.

A solenoid 20 housed in the casing 10 or in an auxiliary casing attached to the casing 10 operates on another member of the structure 30. The solenoid comprises a fixed magnetic circuit 21, a mobile armature 22 and a coil 23 electrically connected to terminals 24 by a switch 25; the latter can be operated by the mechanism 17 and/or by a pushbutton 26 adapted to operate on the mechanism to open the contacts, to confirm opening thereof by the lever 18. The armature 22 of the solenoid is attached to a return spring 27 and cooperates with a lever 28 which is attached directly to the structure 30.

Figure 7:
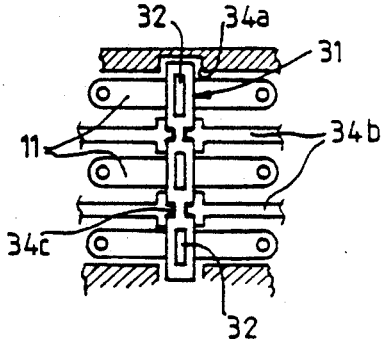
FIG. 7 is a plan view of the structure from FIG. 1.

The contact-carrier structure 30 comprises an omnipolar mobile support 31, contact bridges 11 and unipolar slide members 32 housed in wells or slots 33 in the support 31 in which they can move. The support 31 is mounted to slide against walls 34*a* or partition walls 34*b* of the casing (see FIG. 7). It includes slots 34*c* into which the partition walls extend.

Each contact bridge 11 is slidably housed between a top abutment 35 and a bottom position in a window 36 of the support 31. A contact pressure spring 37 associated with the bridge is also housed in the window so as to bear on one end thereof and on the bridge. The lever 28, which is forked in this example, is coupled by its ends 38 into lateral recesses 39 of the support 31 to form between the armature and the support a coupling that is not loaded by the lever 18; the lever 28 raises the support when the coil 23 is energized and the spring 27 lowers it when the coil is not energized, respectively to close and to open all of the contacts. Note that opening of the contacts by the solenoid does not need to compress the springs 37.

The lever 18 can be applied to all of the slide members so that, when tripping occurs on a fault condition, the slide members entrain the contact bridges and compress the springs 37, leaving the support 31 in its raised position until the solenoid confirms the opening of the contacts by lowering the support when the switch 25 opens. In an alternative embodiment, each magnetic tripping device of the system 16 can additionally cooperate with a lever separate from the lever 18 which strikes the respective slide member after release of the mechanism 17, which assists opening of the contacts in response to fault currents near the repulsion threshold.

Each slide member 32 is a flat and light piece of electrically insulative material having near its lower end a window 40 in which the contact bridge 12 and the associated contact pressure spring 37 are mounted. When the contacts are closed the window 40 of the slide member 32 opens onto the corresponding window 36 of the support. Studs 41 are provided in the support 31 at the bottom of the window 40 on either side of the slot 33 and a guide 42 is provided in the slide member 32 at the bottom of the window 40. The slide members may have a different cross-section.

The contact bridge is mounted in the window 40 in such a way that it is substantially fastened to or immobilized in translation relative to the slide member but is able to move angularly relative to its nominal position perpendicular to the median plane X of the slide member which is also the plane of symmetry of the support and of the contact bridges. The expression "fastened to or immobilized in translation relative to" is intended to mean that the slide member is able to entrain the bridge and that the bridge is able to entrain the slide member in the contact opening direction. To this end notches 43 are provided at the top of the window 40 and cooperating projections 44 on the bridge 12. After the contact bridge is inserted into the window 40 of the slide member the projections 44 are crimped into the notches 43. As a result of the previously mentioned relative angular movement, the tolerances or clearances at the contact pads do not cause jamming of the slide members 32 in their guide wells 33. When a bridge 11 is repelled, it entrains the slide member and the part 45 of the latter above the opening 40 forms a curtain between the two contact areas of the pole. The arrangement described makes it possible to reduce the distance between the fixed contacts of the same pole and therefore to obtain a shorter and lighter mobile bridge.

The operation of the device in accordance with the invention will now be described with reference to FIGS. 8 through 10.

Figure 8:
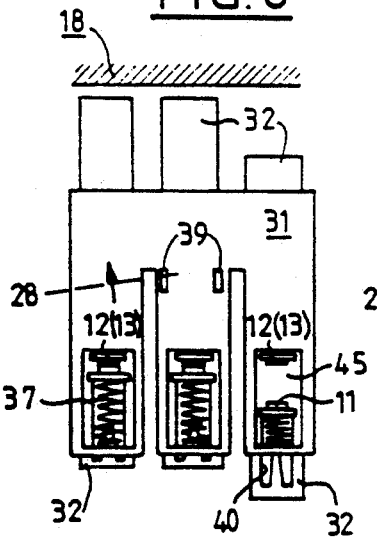
FIGS. 8 through 10 are views in elevation of the structure from FIG. 2 respectively in automatic shut-off and fault shut-off positions.

Referring to FIG. 8, the two contact bridges 11 on the left are shown in the contact closed position. The coil 23 of the solenoid is then energized and its armature 22 is attracted towards the yoke 21. The lever 28 has pivoted anti-clockwise and raised the support 31 until the contacts are closed and the springs 37 compressed. The slide members 32 have been raised to their top position by the bridges 11. The mechanism 17 is armed.

The electrodynamic repulsion of a contact bridge is shown in the righthand part of FIG. 8. In the event of a short-circuit affecting this pole, the contact bridge 11 may be pushed downwards, as shown, entraining the coupled slide member and compressing the spring 37. Note that the insulative area 45 of the slide member appears in the window 36 of the support which provides good insulation between the fixed contacts 12, 13 and the contact opening areas of the short-circuited pole.

Figure 9:
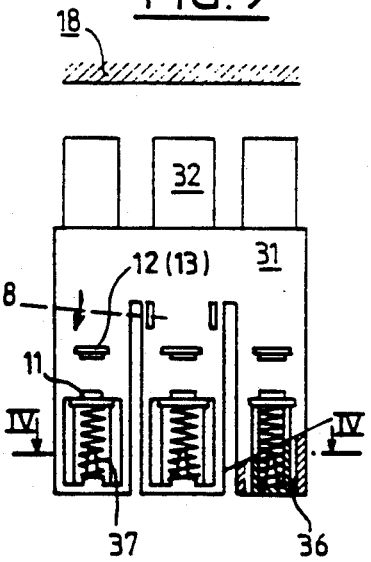

FIG. 9 shows the contact-carrier structure in the position it adopts when the contacts are opened by the solenoid. The coil 23 is de-energized, the armature 27 returns towards the right because of the action of the spring 27 specific to the solenoid and the lever 28 is forced to pivot clockwise to move the support 31 into the position shown. The contact bridges 11 first bear against the top abutments 35 of the windows 36 while the slide members 32 are offset slightly in the windows 35; the bridges then continue their movement and entrain the slide members to the position shown.

Figure 10:
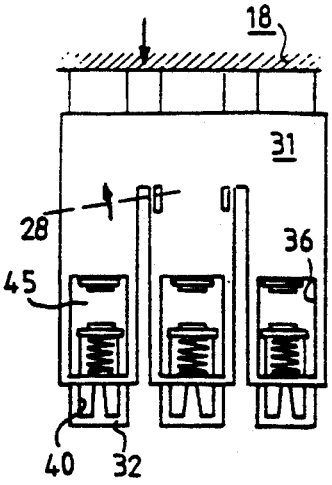

In FIG. 10 the contact-carrier structure occupies the open position it adopts after tripping. The support 31 remains in the same raised position as that of FIG. 8 for as long as the solenoid coil is energized. The lever 18 is lowered and pushes down the slide members 32 which entrain the contact bridges to the position shown. The insulative areas 45 are interposed as before to improve the insulation. The support 31 will subsequently be lowered by the lever 28 in response to opening of the switch 25 which de-energizes the coil of the solenoid.

Figure 11:
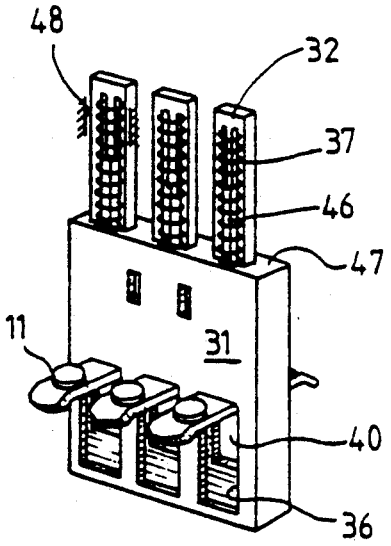
FIG. 11 is a perspective view of an alternative embodiment of the contact-carrier structure in accordance with the invention.
Figure 12:
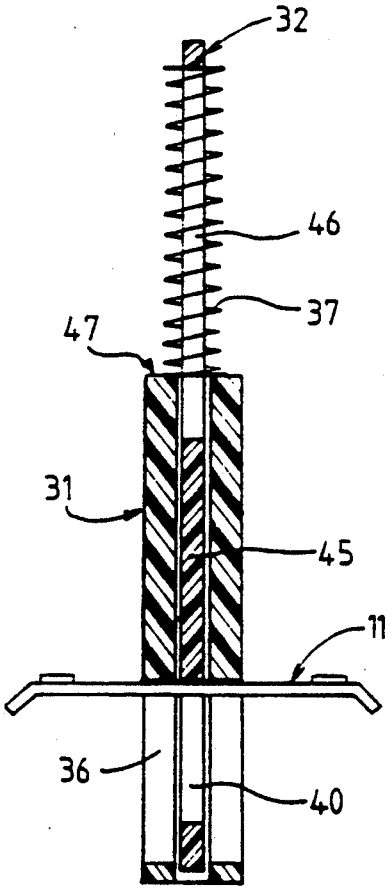
FIG. 12 is an elevation view in cross-section of the contact-carrier structure from FIG. 11.

In the preferred embodiment of FIGS. 11 and 12 each contact pressure spring 37 is accommodated in a top window 46 of the slide member 32. The window 46 is separated from the bottom window 40 accommodating the bridge 11 by the insulative area 45 which closes off the window 36 of the support in the case of omnipolar or unipolar opening. The spring 37 bears on a top surface 47 of the support 31 and on a top end of the top window 46; its location away from the areas in which arcing occurs prevents it from being polluted and/or damaged by the gases generated when the contacts are opened. Each slide member 32 is advantageously guided in an appropriate slideway 48 of the casing of the device.

Modifications may be made to the embodiment described. In particular, the slide members may be in the form of forks whose branches are guided in slots or grooves provided on the outside surfaces of the support. The contact pressure springs may be tension springs.

The invention has been described with reference to a contactor/circuit-breaker. It is applicable to circuit-breakers of other types, for example a starter type circuit-breaker comprising two tripping mechanisms one operated manually and the other by magnetic tripping devices to operate respectively on the slide members and the supports or a circuit-breaker in which the magnetic tripping devices operate directly on the slide members and indirectly, that is to say through the intermediary of a lock, on the support.

We claim:

1. Circuit-breaker or contactor/circuit-breaker type protective switch comprising:

at least one double-contact switch pole provided with a contact bridge cooperating with two fixed contacts, a mobile support for said contact bridge slidably housing said bridge and which bears at least a contact pressure spring which supports said bridge, an operating mechanism adapted to open and close said contacts by displacement of said mobile support, and a tripping mechanism comprising a magnetic and/or thermal tripping device adapted to operate in response to an electrical fault on at least one of said contact bridges via a control part to open said contacts, wherein each contact bridge is fastened in translation to a respective slide member which is housed movably in said support and which can be entrained by said control part.

2. Protection switch according to claim 1 wherein said slide member has a window to accommodate a contact bridge opening onto a corresponding window of said support when said contacts are closed and an insulative area appearing in said window of said support when said contacts are opened by said control part or by electrodynamic repulsion of said contact bridge.

3. Protective switch according to claim 1 wherein said contact bridge is immobilized in translation in a window of said slide member by means of cooperating members allowing angular movement of said bridge relative to said slide member.

4. Protective switch according to claim 1 wherein said contact pressure spring is mounted on said slide member away from the contact opening area.

5. Protective switch according to claim 4 wherein said slide member has a window away from the contact opening area and separated from said window which houses said contact bridge by said insulative area.

6. Protective switch according to claim 1 wherein a control part actuated by a mobile armature of a solenoid is coupled directly to said mobile support.

7. Protective switch according to claim 1 wherein said magnetic tripping device of said tripping mechanism operates said control part in response to a fault to entrain said slide member and an additional lever to strike said slide member.

8. Protective switch according to claim 1 wherein each slide member is guided in a slideway of said casing of said switch.

* * * * *